US010463126B2

(12) United States Patent
Mallory et al.

(10) Patent No.: US 10,463,126 B2
(45) Date of Patent: Nov. 5, 2019

(54) INTERCHANGEABLE FINGER-GRIP ATTACHMENT CASE

(71) Applicants: Jarrod Mallory, Washington, UT (US); Marianne Mallory, Washington, UT (US)

(72) Inventors: Jarrod Mallory, Washington, UT (US); Marianne Mallory, Washington, UT (US)

( * ) Notice: Subject to any disclaimer, the term of this patent is extended or adjusted under 35 U.S.C. 154(b) by 0 days.

(21) Appl. No.: 16/270,866

(22) Filed: Feb. 8, 2019

(65) Prior Publication Data

US 2019/0246756 A1 Aug. 15, 2019

Related U.S. Application Data

(60) Provisional application No. 62/640,972, filed on Mar. 9, 2018, provisional application No. 62/724,187, filed on Aug. 29, 2018, provisional application No. 62/629,630, filed on Feb. 12, 2018.

(51) Int. Cl.

| | |
|---|---|
| ***H04M 1/00*** | (2006.01) |
| ***A45C 11/00*** | (2006.01) |
| ***A45C 13/30*** | (2006.01) |
| ***A45F 5/00*** | (2006.01) |

(52) U.S. Cl.

CPC ..... *A45C 11/00* (2013.01); *A45C 13/30* (2013.01); *A45F 5/00* (2013.01); *A45C 2011/002* (2013.01); *A45F 2005/002* (2013.01)

(58) Field of Classification Search

CPC ..... A45F 5/00; A45F 2005/006; A45F 3/14; A45C 13/30; A45C 11/00; A45C 2011/003

See application file for complete search history.

(56) References Cited

U.S. PATENT DOCUMENTS

| | | | | |
|---|---|---|---|---|
| 8,676,279 | B2 | 3/2014 | McCurdy | |
| 8,690,211 | B2 | 4/2014 | Potter et al. | |
| 8,746,448 | B1 * | 6/2014 | Bellace | A45F 5/00 206/320 |
| 8,833,620 | B2 * | 9/2014 | Interdonato | H04B 1/385 224/217 |
| 8,950,638 | B2 | 2/2015 | Wangercyn, Jr. et al. | |
| 9,155,377 | B2 * | 10/2015 | Wangercyn, Jr. | H04B 1/385 |

(Continued)

OTHER PUBLICATIONS

Prior Art.

*Primary Examiner* — Nhan T Le

(74) *Attorney, Agent, or Firm* — Shaver & Swanson, LLP; Scott D. Swanson

(57) ABSTRACT

What is disclosed is an attachment for a portable media device that case that is configured for attachment to a flexible strap. An end of the flexible strap is configured to slide along the attachment in a track to form an adjustable loop. A plurality of straps can be provided to allow a user to vary the color and/or shape of the strap. What is further disclosed is a portable media case having the track integral with the case. The case is configured to provide protection to a mobile device, including but not limited to a mobile phone. The case with flexible strap forming a loop provides a mechanism to secure a mobile device in the hand of a user or to mount the device. Alternatively the attachment can be formed as an insert into an opening in a case such that the insert and strap are removable from the case.

18 Claims, 9 Drawing Sheets

(56) References Cited

U.S. PATENT DOCUMENTS

| | | | | |
|---|---|---|---|---|
| 2012/0187706 | A1 | 7/2012 | Kannaka | |
| 2012/0299318 | A1* | 11/2012 | Murphy | A45F 5/00 294/25 |
| 2013/0146625 | A1 | 6/2013 | Karle et al. | |

* cited by examiner

INTERCHANGEABLE FINGER-GRIP ATTACHMENT CASE

PRIORITY/CROSS-REFERENCE TO RELATED APPLICATIONS

This application claims the benefit of U.S. Provisional Patent Application No. 62/629,630, filed Feb. 12, 2018, U.S. Provisional Patent Application No. 62/640,972, filed Mar. 9, 2018, and U.S. Provisional Patent Application No. 62/724,187, filed Aug. 29, 2018, all of which the contents of which are hereby incorporated by reference.

TECHNICAL FIELD

The presently disclosed technology relates generally to an attachment and/or case for use with a portable media device, and more specifically to a case for use with a cellular phone or other mobile device.

BACKGROUND OF THE INVENTION

Currently, mobile devices are becoming larger and larger, and a large mobile device is now standard for many people. These mobile devices are becoming more and more difficult to grasp, and an issue with them is that they are easily dropped or slide out of the users hand when they attempt to reach across the screen to text or take a photo. This is even more so the case when it comes to computer tablets. What is needed is a device that allows the case to be easily held in the hand of the user without slipping from the user's hand. What is further needed is a case that will house the device, and allow the device to fit neatly into the case so as to fit and slide neatly into the pocket of the user.

SUMMARY OF THE INVENTION

Figure 1:
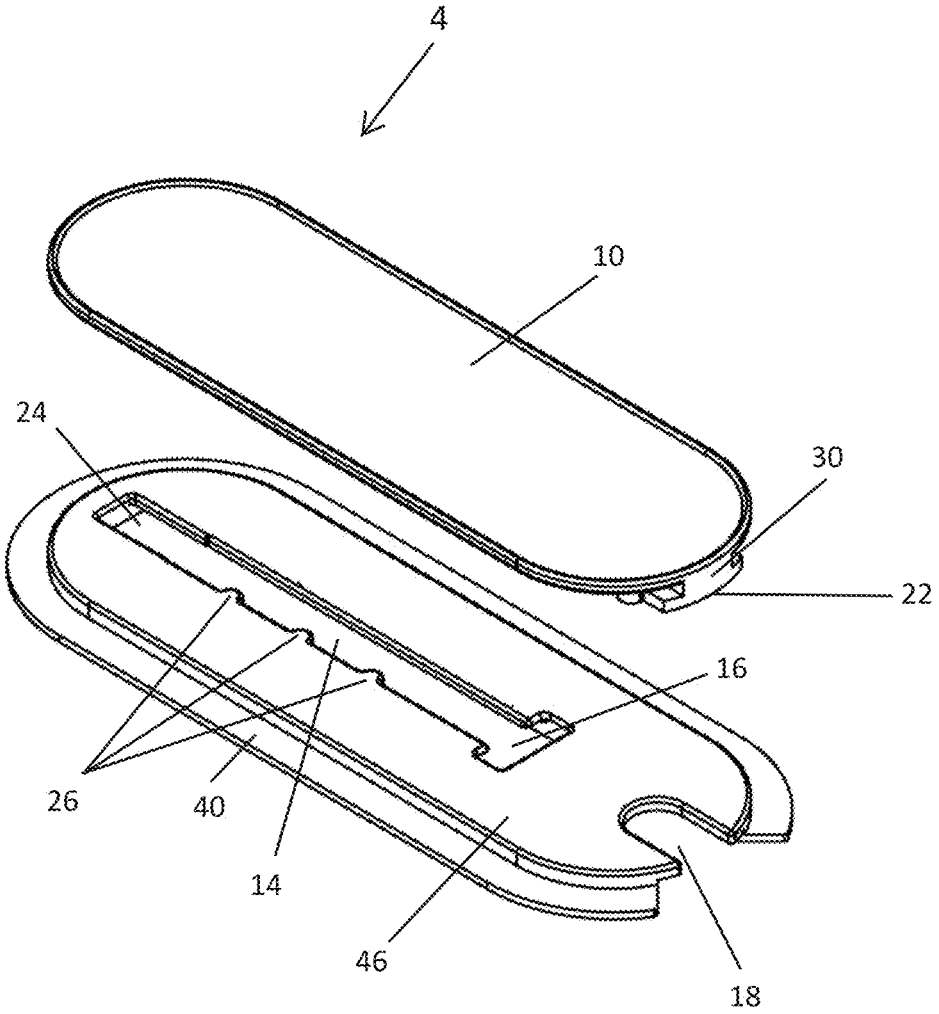
FIG. 1 is a top perspective view of a preferred embodiment of the flexible strap unattached to the attachment base.

The purpose of the summary is to enable the public, and especially the scientists, engineers, and practitioners in the art who are not familiar with patent or legal terms or phraseology, to determine quickly from a cursory inspection, the nature and essence of the technical disclosure of the application. The summary is neither intended to define the inventive concept(s) of the application, which is measured by the claims, nor is it intended to be limiting as to the scope of the inventive concept(s) in any way.

What is disclosed herein is an interchangeable finger-grip attachment and case for a mobile device. In a preferred embodiment the case utilizes a first opening and a second opening to removably attach a flexible strap. The second opening is preferably a track in which a second end of the flexible strap is configured to slide. The track can include notches or cutouts that are configured to retain the second end of the flexible strap at certain positions within the track. The flexible strap is configured to form a loop in association with the case when the first end and the second end of the flexible strap are attached to the case. The loop formed by the flexible strap and the case adjusts when the second end of the flexible strap slides toward and away from the first end of the flexible strap attached to the case. In a further embodiment the track and flexible strap are configured such that the flexible strap can take a generally flat orientation against the case when the second end of the strap is slid away from the first end of the strap.

In a further preferred embodiment the interchangeable finger-grip case includes a flexible strap and an insert. In a preferred embodiment the insert utilizes a flanged edge that is around a perimeter of the insert. The flanged edge can partially or completely surround the insert. In a preferred embodiment the flanged edge secures the insert to a compatible case for a mobile device by pressing the insert's flanged edge against the case, securing an interchangeable finger-grip insert into place.

The flexible strap preferably has an anchoring piece on its first end and a sliding button on its second end. The insert has preferably two openings, one to anchor a first end of the flexible strap to the insert, and a second opening that is track-like, allowing the sliding button on the second end of the flexible strap to slide toward and away from the first opening and the first end of the flexible strap attached thereto. When the second end of the flexible strap is brought closer to the first end, the flexible strap bends outward from the case and it can then be used to grab or slide a hand or finger through in order to make handling or carrying the mobile device easier.

Still other features and advantages of the claimed invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the description of the preferred embodiments is to be regarded as illustrative in nature, and not as restrictive in nature.

DETAILED DESCRIPTION OF THE PREFERRED EMBODIMENTS

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Figure 2:
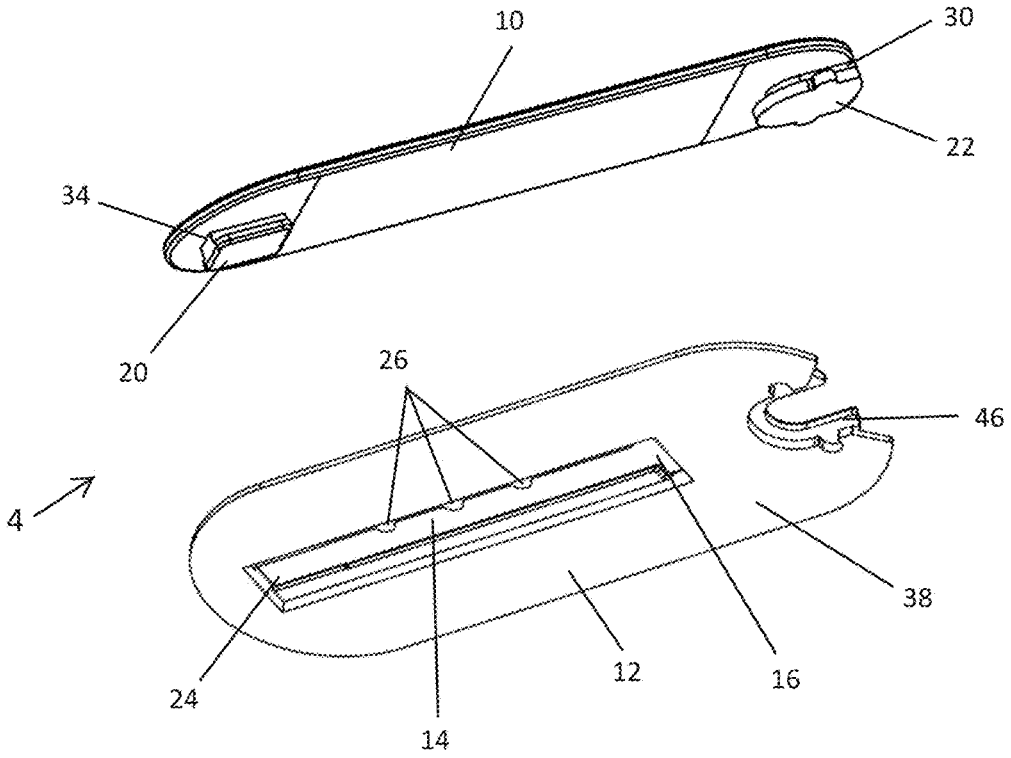
FIG. 2 is a bottom perspective view of a preferred embodiment of the flexible strap unattached to the attachment base.
Figure 6:
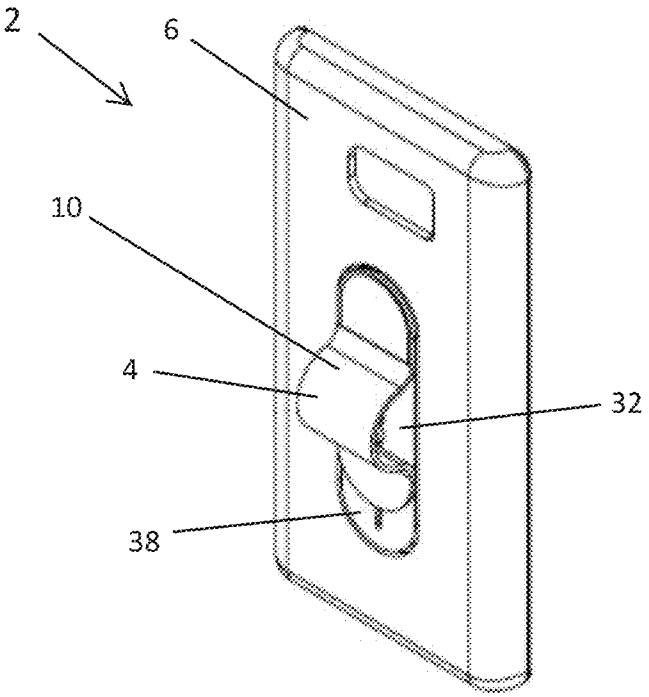
FIG. 6 a top perspective view of a preferred embodiment of an attachment configured as an insert for a case mated with a case.

FIGS. 1 and 2 depict a preferred embodiment of an interchangeable finger-grip attachment 4 (case not shown), having a flexible strap 10 and a base 12. The flexible strap 10 has an anchor neck 30 that attaches to the anchor 22 at a first end of the flexible strap. The flexible strap 10 also has a lower narrow neck 34 that attaches to a button like knob 20 at a second end of the flexible strap. In the depicted embodiment the knob acts as a sliding anchor within a track like opening 14 defined in the base 12. The attachment can be configured to attach directly to a portable media device or to a case for a portable media device. Alternatively the finger grip attachment 4 can be configured as an insert that is configured to be a removable insert insertable into an opening in a case as shown in FIG. 6.

In a preferred embodiment the base 12 preferably has an interior portion 38 with an elevated exterior portion 46. The track-like opening 14 is defined in the exterior portion 46 of the base. The base 12 has a flange 40, which is a continuous extension of the interior portion 38 extending out from the exterior portion 46. The track-like opening 14 runs the length of the base 12, and the track-like opening 14 begins with a large opening 16 and ends with a narrow lower end 24. The track-like opening 14 is narrower through the exterior portion 46 and accommodates the dimensions of the lower narrow neck 34, and the track-like opening 14 is wider through the interior portion 38 to accommodate the dimensions of the button-like knob 20.

In a preferred embodiment, the base 12 has a semi-enclosed opening 18 that fits congruently to the anchor 22. The semi enclosed opening 18 is wider at the interior portion 38 to fit the dimensions of the anchor 22, and is more narrow at the exterior portion 46 to fit the dimensions of the anchor neck 30. The anchor 22 slides down into the semi-enclosed opening 18 and secures the flexible strap 10 to the base 12. In alternate embodiments the semi-enclosed opening can be fully enclosed and the anchor 22 can snap into or attach to the opening through other known anchoring means.

In a preferred embodiment, the large opening 16 of the track-like opening 14 has similar dimensions to the button like knob 20 of the flexible strap 10. The button-like knob 20 is inserted through the large opening 16 and slides toward the narrow lower end 24 of the track-like opening 14. The upper anchor 22 remains fixed in position while the button-like knob 20 slides up and down the track-like opening 14, causing the flexible strap 10 to create a circumference for a user to slide a hand or finger between the flexible strap 10 and the base 12. The circumference increases when the button-like knob 20 is positioned closer to the upper anchor 22 and decreasing when the button-like knob 20 is positioned closer to the narrow lower end 24. In a preferred embodiment, the track-like opening has multiple teeth 26, which prevent regular movement of the button-like knob 20 without assistance by a user.

In a preferred embodiment the flexible strap 10 is made from a flexible plastic. In alternate embodiments, the flexible strap 10 and base 12 can be made from woven material or fabric, or other known materials in the art. In a preferred embodiment the base 12 is made from a solid plastic material. In alternate embodiments the base can be made from the same material as the flexible strap, metal, woven material or fabric, or other materials known in the art.

Figure 3:
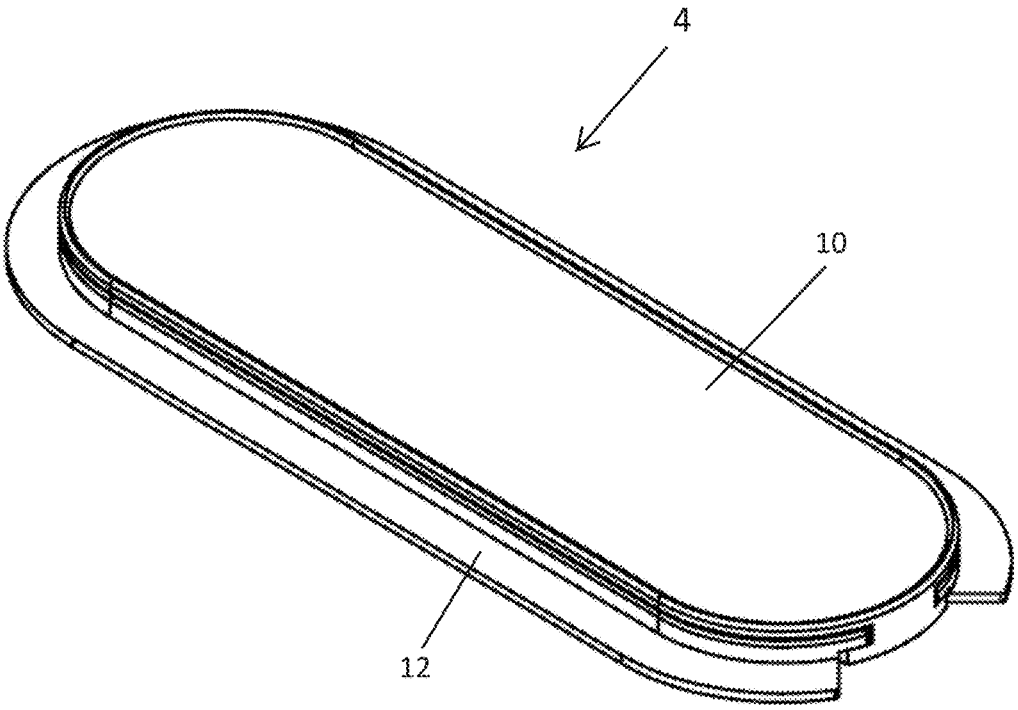
FIG. 3 is a top perspective view of a preferred embodiment of the flexible strap attached to the attachment base.

FIG. 3 depicts a preferred embodiment an interchangeable finger-grip attachment 4 (case not shown), with the flexible strap 10 attached to the base 12 in a flat, extended position. An interchangeable finger-grip attachment 4 is inserted into the opening 8 of the case 6, as depicted in FIG. 6. When flexible strap 10 is in this flat position, an interchangeable finger-grip attachment 4 is flat with the case of the mobile device, allowing it to easily slide into a pocket or other area without snagging.

Figure 4:
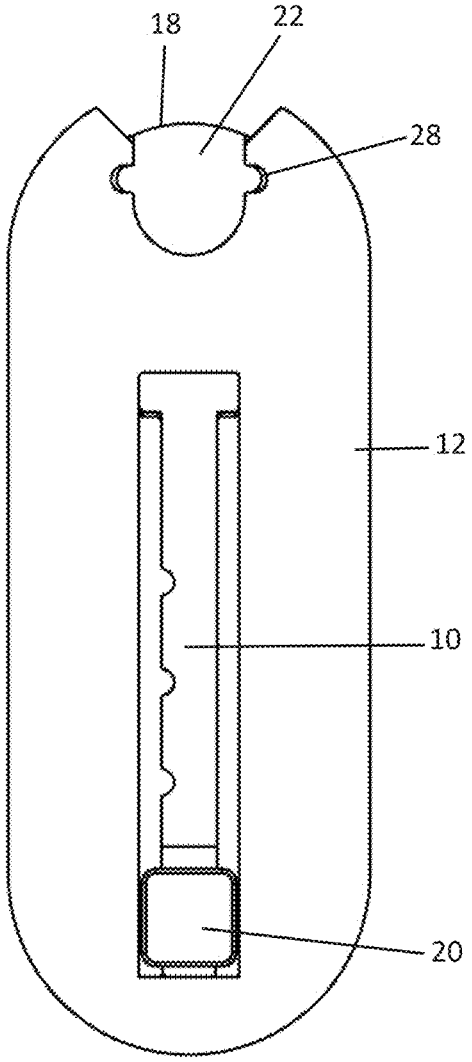
FIG. 4 is a bottom perspective view of a preferred embodiment of the flexible strap attached to the attachment base with the flanged edge of an interchangeable finger-grip attachment.

FIG. 4 depicts a preferred embodiment of an interchangeable finger-grip attachment 4 (case not shown), with the flexible strap 10 attached to the base 12 in a flat extended position. With the flexible strap 10 fully extended, the button-like knob 20 is at the narrow lower end 24 of the track-like opening 14. In a preferred embodiment, the anchor 22 has anchor teeth 28 that prevent the anchor 22 from sliding off of the base 12. In an alternate embodiment, the semi-enclosed opening 18 can encircle the anchor 22.

Figure 5:
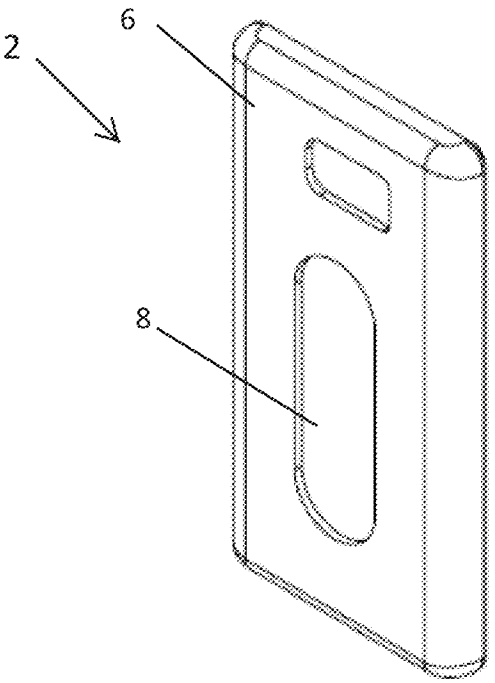
FIG. 5 is a top perspective view of a preferred embodiment of a case configured for accepting an interchangeable finger-grip attachment.
Figure 7:
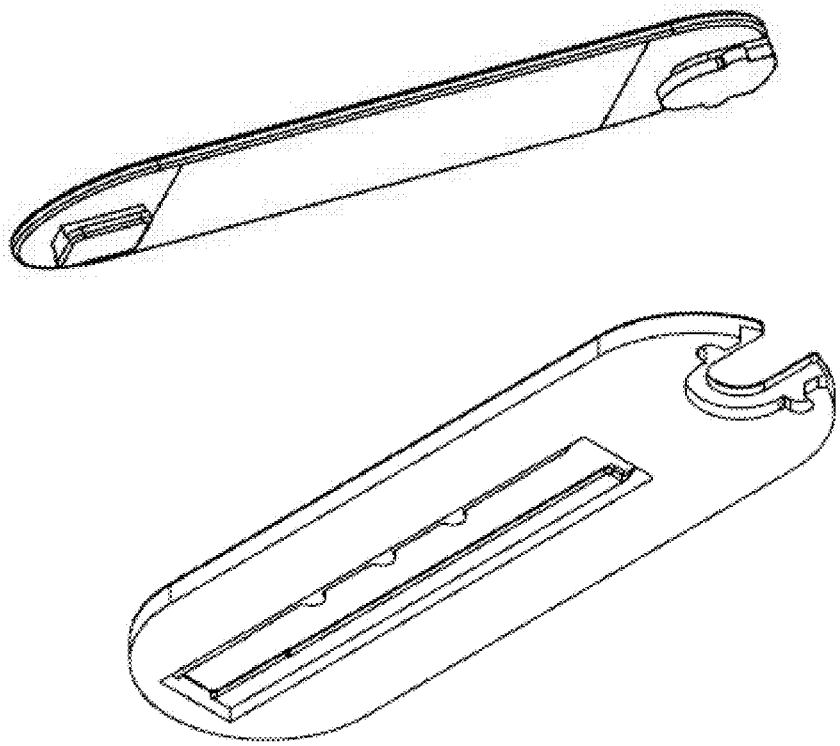
FIG. 7 is a perspective view of an interchangeable finger-grip attachment base configured without a flanged edge.

FIG. 5 depicts a preferred embodiment of the case 6. In a preferred embodiment, the case has an opening 8 that is configured to the dimensions of an interchangeable finger-grip attachment 4. In alternate embodiments, the interior of the case 6 opening 8 can have a depression that lines the opening (corresponding to the flange 40 of an interchangeable finger-grip attachment 4 (not shown)).

FIG. 6 depicts a preferred embodiment of an interchangeable finger-grip attachment case 2 with an interchangeable finger-grip attachment 4 attached to the case 6. In a preferred embodiment the exterior portion 38 of the base 12 fits in the opening of the case 6 securely as the flange 40 (not shown) is pressed against the case 6 when a mobile device (not shown) is inserted and secures an interchangeable finger-grip attachment 4 to the case 6. In alternate embodiments the flange 40 can use an adhesive to secure an interchangeable finger-grip attachment 4 to the case 6. FIG. 6 depicts the loop 32 that can be used for mounting or a user can slide their finger in. The loop 32 is adjustable depending on the sliding position of the flexible strap 10.

Figure 8A:
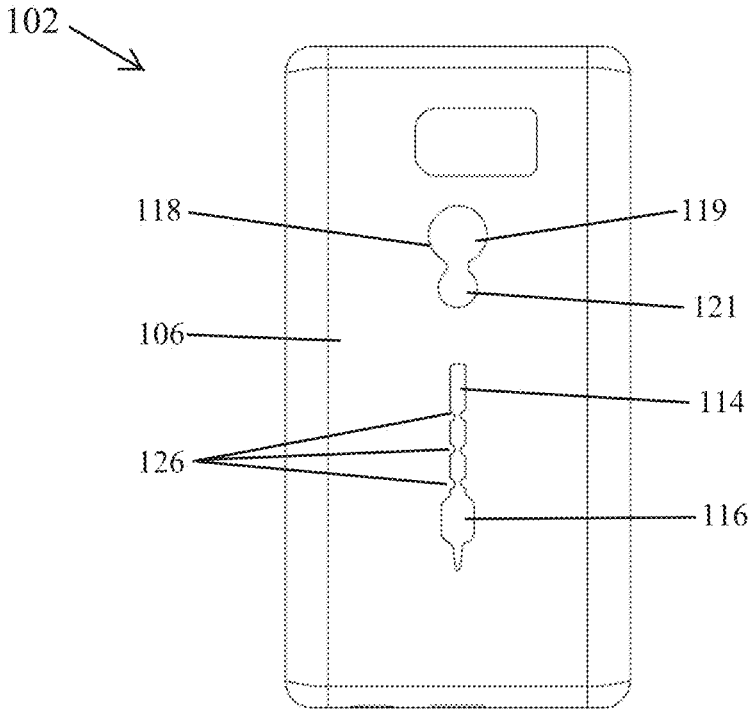
FIG. 8*a* is a front view of an alternate embodiment of a case configured for direct attachment to a flexible strap.
Figure 8B:
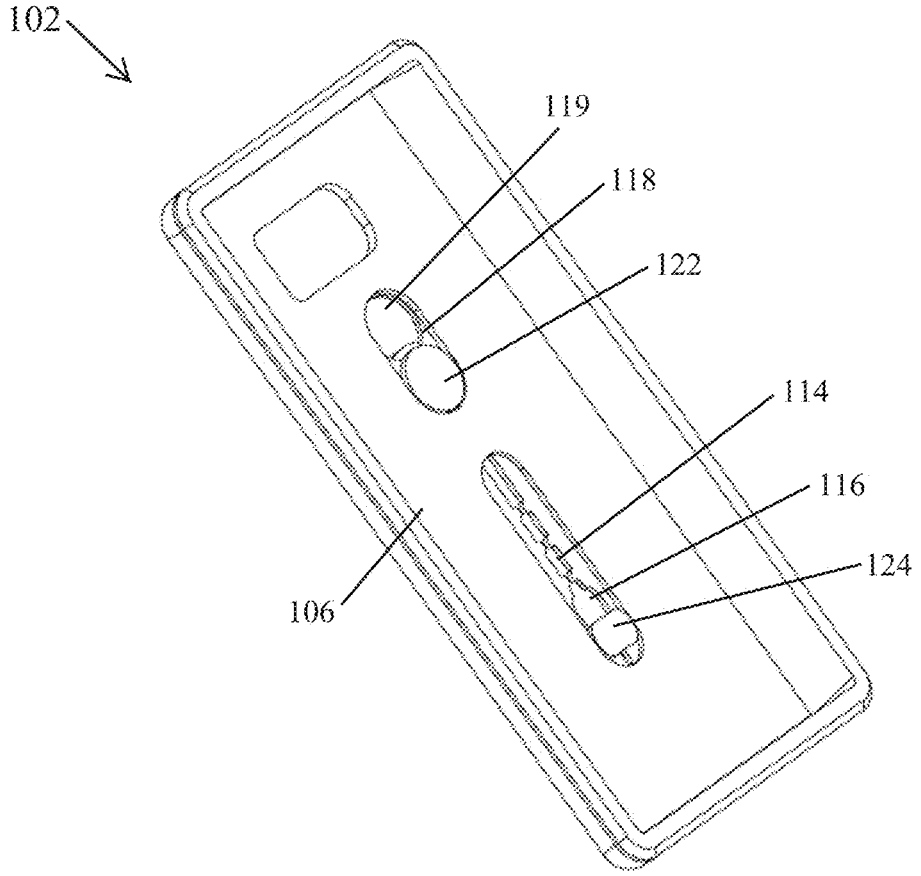
FIG. 8*b* is a rear perspective view of an alternate embodiment of an interchangeable finger-grip attachment case.
Figure 8C:
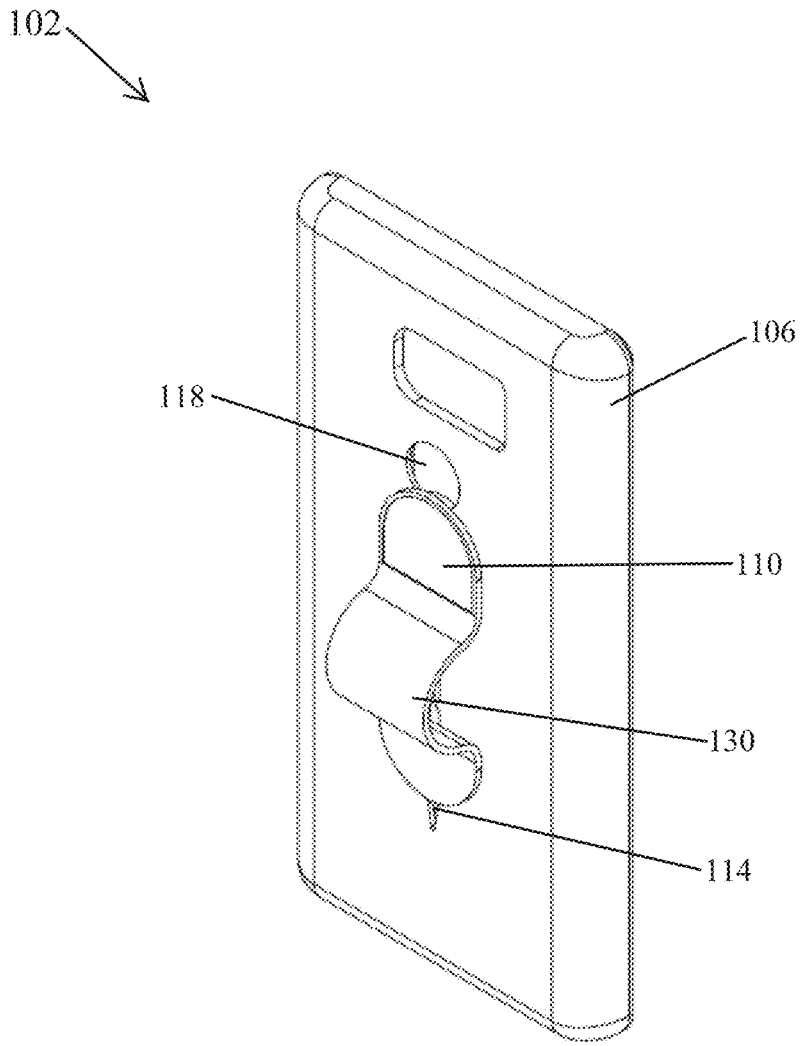
FIG. 8*c* is a front perspective view of an alternate embodiment of an interchangeable finger-grip attachment case.

FIGS. 8*a*, 8*b*, and 8*c* depict an alternative embodiment of the interchangeable finger-grip attachment case 102, with the track-like opening 114 integrated into the case 106. In this alternate embodiment, as depicted in FIG. 8*a*, the case 106 has an anchor opening 118 with an upper opening 119 and a lower opening 120. The track-like opening 114 is integrated into the case 106, and has a large opening 116 that is configured for a button-like knob 124. Within the track-like opening are a series of teeth 126 that retain the button-like knob 124 of the flexible strap 110 (not shown).

As depicted in FIG. 8*b*, the flexible strap 110 (not shown) is secured directly to the case 106 by the anchor 122 fitting into an anchor opening 118. The anchor 122 fits into the upper opening 119 and snaps down into the lower opening 120 (not shown), securing the anchor 122 in place. The button-like knob 124 also attaches and inserts into the large opening 116 of the track-like opening 114. The button-like knob 124 is secured in place by the edges of the track-like opening 114 and within a cavity of the case 106, allowing the button-like knob to rest against a mobile device when inserted into the case 106.

As depicted in FIG. 8*c*, when the flexible strap 110 is attached to the case 106 at the anchor opening 118 and the track-like opening 114, the flexible strap 110 is configured to define a loop 130 for a user to insert their hand or finger by sliding the flexible strap 110 up and down the track-like opening 114 of the case 106.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

What is claimed is:

1. A case for a portable media device comprising:

a case for housing a portable media device, said case defining a first opening and a second opening, wherein said first opening is configured for attachment to a first end of a flexible strap, wherein said second opening comprises a track-like opening configured for attachment of a second end of said flexible strap, wherein said second of said flexible strap is configured to slide in said track like opening; and a flexible strap, said flexible strap having a first end and a second end, wherein said a first end of said flexible strap is configured for attachment to said first opening, wherein a second end of said flexible strap is configured for slideable attachment to said case in said track like opening, wherein said flexible strap is configured to form a loop when said second end of said flexible strap slides from a first position to a second position in said track like opening.

2. The case of claim 1 wherein said case comprises a removable insert, wherein said flexible strap is attached to said removable insert.

3. The case of claim 1, wherein said flexible strap is removably attached to said insert.

4. The case of claim 1, wherein said flexible strap comprises a first end knob at said first end of said flexible strap, wherein said first end knob is configured for connection to said first opening of said case.

5. The case of claim 1, wherein said flexible strap comprises a second end knob at said second end of said flexible strap, wherein said second end knob is configured for connection to said second opening of said case.

6. The case of claim 1, wherein said case is configured with an opening for a screen of a portable media device.

7. The case of claim 1, wherein said case is configured to envelop a portable media device.

8. The case of claim 1, wherein said first end of said flexible strap is fixedly attached to said case.

9. The case of claim 1, wherein said case comprises a cellular phone case.

10. The case of claim 1, wherein said case comprises a plurality of interchangeable flexible straps.

11. A case for a portable media device comprising:

a case for housing a portable media device, said case defining an opening for an insert; and an interchangeable finger-grip insert, said interchangeable finger-grip insert configured for mating engagement with said opening of said case; and a flexible strap, wherein said flexible strap comprising a first end and a second end, wherein said flexible strap is configured to attach to said insert at said first end and to slideably attach to said insert at said second end, wherein said flexible strap is configured form a loop with said case when said second end of said flexible strap slides toward said first end of said flexible strap wherein said flexible strap comprises a first knob and a second knob, said first knob being configured to secure to said first insert opening, and said second knob configured to attach to said second insert opening and to slide in said track.

12. The case of claim 11 wherein said insert further comprises a flange, said flange comprising a perimeter of said insert, wherein said flange is configured to mate with an edge of said opening for an insert such that said insert is secured in said opening between a portable media device housed in said case and said case.

13. The case of claim 11 wherein said second insert opening defines a track.

14. An attachment for a portable media device comprising:

an attachment base, said base configured to attach to a surface of a portable media device:

a flexible strap, said flexible strap having a first end and a second end; said flexible strap being configured to attach to said attachment base at said first end of said flexible strap and at said second end of said flexible strap;

said attachment base having a first end and a second end, and wherein said base defining a first attachment base opening and a second attachment base opening, wherein said first attachment base opening is configured for attachment of said first end of said flexible strap, wherein said second attachment base opening is configured for slideable attachment of said second end of said flexible strap, wherein said flexible strap is configured to form a loop when attached to said attachment base, wherein said flexible strap loop is configured to adjust in shape when said second end of said flexible strap slides in said track.

15. The attachment base of claim 14, wherein said attachment base comprises a flange, wherein said attachment base is configured to attach to an opening in a case, wherein said case comprises a case opening flange, wherein said attachment base flange and said case opening flange are configured to mate.

16. The attachment base of claim 14 wherein said first end of said flexible strap comprises a first knob and said second end of said flexible strap comprises a second knob, wherein said first knob being configured to secure to said first attachment base opening, and said second knob being configured to attach to said second attachment base opening and to slide in said track.

17. The attachment base of claim 14 wherein said track defines a series of notches, wherein said notches are configured to retain said second end of said flexible strap from sliding unassisted.

18. The attachment base of claim 16 wherein said first attachment base opening comprises a series of notches, said notches being configured to retain said first knob of said flexible strap.

* * * * *